US006494960B1

(12) United States Patent
Macdonald et al.

(10) Patent No.: US 6,494,960 B1
(45) **Date of Patent: *Dec. 17, 2002**

(54) METHOD FOR REMOVING AN ALUMINIDE COATING FROM A SUBSTRATE

(75) Inventors: Leo Spitz Macdonald, Petersburgh, NY (US); D. Sangeeta, Cincinnati, OH (US); Mark Alan Rosenzweig, Hamilton, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/303,755

(22) Filed: May 3, 1999

Related U.S. Application Data

(63) Continuation-in-part of application No. 09/067,780, filed on Apr. 27, 1998, now Pat. No. 5,976,265.

(51) Int. Cl.[7] ..... C23G 1/02

(52) U.S. Cl. ..... 134/3; 134/28; 134/41; 510/201; 510/202; 510/269

(58) Field of Search ..... 134/3, 41, 2, 26, 134/28, 34, 22.1, 22.12, 22.13, 22.14; 510/175, 201, 202, 209; 204/146

(56) References Cited

U.S. PATENT DOCUMENTS

| | | | | |
|---|---|---|---|---|
| 3,607,398 | A | | 9/1971 | Lucas |
| 3,622,391 | A | | 11/1971 | Baldi |
| 3,779,879 | A | | 12/1973 | Scott |
| 3,833,414 | A | * | 9/1974 | Grisik et al. ..... 134/3 |
| 4,032,359 | A | * | 6/1977 | Fisher et al. ..... 134/3 |
| 4,327,134 | A | * | 4/1982 | Baldi ..... 427/253 |
| 4,339,282 | A | | 7/1982 | Lada et al. |
| 4,425,185 | A | | 1/1984 | Fishter et al. |
| 4,554,049 | A | * | 11/1985 | Bastenbeck ..... 156/656 |
| 4,608,091 | A | * | 8/1986 | Sullivan et al. ..... 134/3 |
| 4,619,707 | A | * | 10/1986 | Hirschmeier et al. ..... 134/3 |
| 4,678,552 | A | * | 7/1987 | Chen ..... 204/146 |
| 4,746,369 | A | * | 5/1988 | Sullivan et al. ..... 134/3 |
| 4,834,912 | A | * | 5/1989 | Hodgens et al. ..... 134/2 |
| 4,944,851 | A | * | 7/1990 | Cordani et al. ..... 204/106 |
| 5,441,574 | A | | 8/1995 | Hansen et al. |
| 5,976,265 | A | | 11/1999 | Sangeeta et al. |

FOREIGN PATENT DOCUMENTS

| | | |
|---|---|---|
| EP | 0161387 | 1/1985 |
| FR | 2520374 | 1/1983 |
| GB | 1565107 | 7/1977 |
| GB | 2115013 | 1/1983 |

OTHER PUBLICATIONS

Sigma Aldrich: Product Overview http://www.sigma–aldrich.com/sigma–aldrich/55493_safc_po.pdf.*

* cited by examiner

*Primary Examiner*—Randy Gulakowski
*Assistant Examiner*—Gentle Winter
(74) *Attorney, Agent, or Firm*—Paul J. DiConza; Noreen C. Johnson

(57) ABSTRACT

A method for removing an aluminide coating from a substrate includes the steps of contacting the surface of the substrate with at least one stripping composition to degrade the coating. The stripping composition includes an aliphatic or aromatic sulfonic acid, and at least one additive. The coating is then removed.

38 Claims, 1 Drawing Sheet

METHOD FOR REMOVING AN ALUMINIDE COATING FROM A SUBSTRATE

This is a Continuation-In-Part of Ser. No. 09/067,780, filed Apr. 27, 1998, U.S. Pat. No. 5,976,265.

BACKGROUND OF THE INVENTION

The invention relates generally to metallurgical processes. More specifically, it is directed to treating processes for metal-based substrates.

A variety of specially-formulated coatings is often used to protect metal parts that are exposed to high temperatures, e.g., metal parts made from superalloys. For example, aluminide coatings are often used to provide oxidation- and corrosion-resistance to superalloys, which can serve as a bond layer between the superalloy substrate and a thermal barrier coating (TBC).

In one process for depositing an aluminide coating, a very thin layer of platinum (e.g., about 1–6 microns) is first applied to the substrate surface by electroplating, and an aluminide material is then applied by a vapor deposition process. The aluminum reacts with the platinum and with the substrate material (e.g., nickel) to form a variety of intermetallic compounds, such as platinum aluminide and nickel aluminide. Upon exposure to oxidation, an aluminum oxide (alumina) film forms on the surface of the aluminide, which serves as a barrier against further reactions with environmental constituents, thereby maintaining the integrity of the substrate.

It is sometimes necessary to repair the aluminide coating. For example, coatings applied on turbine engine parts are frequently repaired when the turbine itself is overhauled. The repair process can involve various steps, including stripping of the aluminide coating, and deposition of a new aluminide coating in the affected area. In current practice, the aluminide materials are often stripped from the substrate by exposure to an acid, such as hydrochloric acid, nitric acid, or phosphoric acid.

The present inventors have recognized drawbacks associated with the use of the various stripping compositions mentioned above. Frequently, the overall procedure is time-consuming, requiring as much as 4–6 hours of contact time with the stripping compositions and with rinsing solutions. Moreover, some of the stripping compositions do not remove sufficient amounts of the aluminide material, and further time and effort are required to complete the removal. Moreover, some of the compositions have low selectivity, as demonstrated by attacking the base metal of the substrate, pitting the base metal substrate or damaging the metal via intergranular boundary attack.

Furthermore, many of the currently-used stripping compositions have to be used at elevated temperatures, e.g., above about 77° C. Operation at these temperatures can attack masking materials that are used to protect selected portions of the part, e.g., airfoil roots or internal surfaces, while also raising energy costs and potentially-requiring additional safety precautions.

Moreover, some of the prior art processes require heavy grit-blasting prior to treatment, to roughen the substrate surface, and after exposure to the stripping compositions. These steps can be time-consuming, and can also damage the substrate, thereby limiting part life.

It is thus apparent that new processes for removing aluminide-based materials from metal substrates would be welcome in the art.

SUMMARY OF THE INVENTION

The present invention relates to methods for removing an aluminide material from a substrate. According to an embodiment of the present invention, a method includes the steps of contacting the surface of a substrate with at least one stripping composition to degrade the coating, wherein the stripping composition is selected from the group consisting of(i) aliphatic or aromatic sulfonic acids; (ii) a solution of an inorganic acid and an organic solvent; and (iii) sulfuric acid or an aqueous solution of sulfuric acid; and (b) removing the degraded coating.

According to an embodiment described in more detail hereinbelow, stripping composition (i), including an aliphatic or aromatic sulfonic acid, further includes an inorganic or organic additive.

Other details regarding the various embodiments of this invention are provided below.

DETAILED DESCRIPTION OF THE INVENTION

Figure 1:
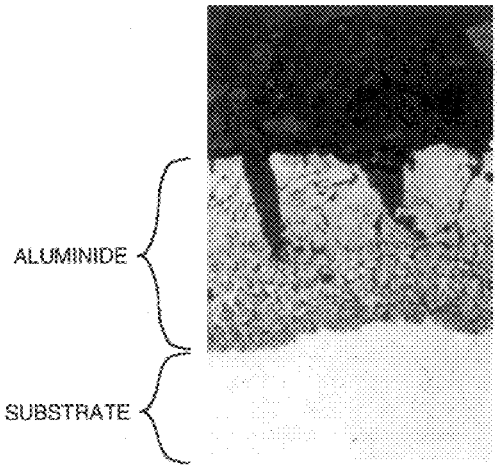
FIG. 1 is a photomicrograph of a cross-section of a platinum-aluminide coating applied on a superalloy substrate, after one stage of treatment.

As used herein, "selective removal" of the aluminide coating refers to the removal of a relatively large percentage of the aluminide-containing material while removing only a very small portion (or none) of the substrate material.

The term "aluminide-containing" in this context is meant to include a variety of materials that are typically used in coating metal alloys (especially superalloys), or which are formed during or after the coating process. Non-limiting examples include aluminide itself, platinum aluminide, nickel aluminide, platinum-nickel aluminide, refractory-doped aluminides, or alloys which contain one or more of those compounds. For the sake of brevity, "aluminide-containing" will sometimes be referred to herein as simply "aluminide" material.

Several different classes of stripping compositions can be used in the embodiments of the invention. The choice of a particular composition will depend on various factors, such as the type of substrate; the type of aluminide coating being removed from the substrate; the intended end use for the substrate; and the presence or absence of additional treatment steps (e.g. rinsing steps).

A first class of stripping compositions (composition (i)) comprises aliphatic or aromatic sulfonic acids. Examples of suitable aliphatic sulfonic acids are methanesulfonic acid (MSA) and ethanesulfonic acid, with methanesulfonic acid being preferred. Illustrative aromatic sulfonic acids are benzene sulfonic acid, toluene sulfonic acid, and naphthalene sulfonic acid.

A second class of stripping compositions (i.e., composition (ii)) includes a solution of an inorganic acid and an organic solvent. Examples of the inorganic acid for this class of compositions are hydrochloric acid, nitric acid, and perchloric acid.

In preferred embodiments, the solvent should be one which reduces the activity and increases the wetting capability of the inorganic acid relative to the substrate. (The chemical interaction between an acid and a hydrocarbon solvent will often differ from the interaction between the acid and a solvent like water). It has been found that the combination of the inorganic acid and the organic solvent removes substantially all of the aluminide coating material without adversely affecting the substrate. As used herein, "activity" generally refers to a measurement of the reactivity of the acid toward the substrate and/or the aluminide coating being removed from the substrate.

Examples of organic solvents for use in combination with the inorganic acid include aliphatic alcohols, aromatic alcohols, chlorinated alcohols, ketones, nitrile-based solvents, nitrated hydrocarbon solvents, nitrated aromatic solvents such as nitrobenzene; chlorinated hydrocarbons, amines, and mixtures of any of the foregoing.

Several specific examples of the aliphatic alcohols are methanol, ethanol, and isopropanol. Mixtures of alcohols may be used as well. Specific examples of the aromatic alcohols are phenols and substituted phenols.

The weight ratio of inorganic acid to solvent for composition (ii) is usually in the range of about 20:80 to about 80:20, and more preferably, in the range of about 35:65 to about 75:25. The specific ratio will depend on various factors, such as the type of acid and solvent(s) used; the type of substrate present; the amount and type of aluminide compound being removed from the substrate; and the reactivity (i.e., corrosion potential) of the acid. One particular composition of this class comprises a mixture of hydrochloric acid and ethanol. The weight ratio of hydrochloric acid to ethanol in such a mixture is usually in the range of about 35:65 to about 65:35.

A third stripping composition for this invention (composition (iii)) comprises sulfuric acid or an aqueous solution of sulfuric acid. For the aqueous solution, the ratio of acid to water is usually in the range of about 10:90 to about 65:35. In preferred embodiments, the ratio is in the range of about 15:85 to about 40:0. Moreover, a wetting agent is usually used in this type of stripping composition, as described below.

The choice of a stripping agent depends on various factors, as described previously. As an example, the mixture of hydrochloric acid and ethanol (e.g., about 50/50 by weight) is effective in removing an aluminide material from a substrate. The use of such a mixture may occasionally result in very slight pitting, or in a small amount of corrosion of the substrate. Any corrosion, however, is substantially uniform. As used herein, "uniform corrosion" refers to the removal of a thin layer of the substrate - usually less than about 2 microns in thickness. Uniform corrosion and slight pitting are not significant drawbacks for some end uses of the substrate. This is in contrast to the occurrence of severe "pitting" (often seen in the prior art), which results in holes in the substrate - often to a depth of at least about 25 microns, and usually to a depth in the range of about 25 microns to about 500 microns.

For end uses in which any pitting of the substrate is unacceptable, a different stripping composition could be employed. For example, methanesulfonic acid is effective at removing aluminide material from the substrate, although the rate of removal is not as high as in the case of HCl-alcohol. A distinct advantage of methanesulfonic acid is that it does not adversely affect the substrate to any substantial degree, beyond uniform corrosion.

In some embodiments, the stripping composition further includes a wetting agent. The wetting agent reduces the surface tension of the composition, permitting better contact with the substrate and the aluminide-based coating. Illustrative wetting agents are polyalkylene glycols, glycerol, fatty acids, soaps, emulsifiers, and surfactants. The wetting agent is usually present at a level in the range of about 0.1% by weight to about 5% by weight, based on the total weight of the composition.

Other additives are sometimes used in the stripping composition. For example, inhibitors are sometimes employed to lower the proton concentration, and thereby lower the activity of the acid in the composition. The lowered activity in turn decreases the potential for pitting of the substrate surface. An exemplary inhibitor is a solution of sodium sulfate in sulfuric acid, or a solution of sodium chloride in hydrochloric acid. The level of inhibitor used is usually about 1% by weight to about 15% by weight, based on the weight of the entire stripping composition. Moreover, oxidizing agents are sometimes used in the stripping composition to prevent the formation of a reducing environment. Examples include peroxides (e.g., hydrogen peroxide), chlorates, perchlorates, nitrates, permanganates, chromates, and osmates (e.g., osmium tetroxide). The level of oxidizing agent used is usually about 0.01% by weight to about 5% by weight, based on the weight of the entire stripping composition. In one embodiment, the oxidizing agent is used with acids that are reducing agents, e.g. hydrochloric acid.

In the first class of stripping compositions, the aliphatic or aromatic acid(s) may be combined with an additive or additives, to increase the effectiveness of the action of the stripping composition. The additive may be an inorganic component, including secondary inorganic acids, reducing agents, complexing agents, and oxidizing agents. The additive may also be an organic component, including organic solvents and complexing agents (complexing agents may be either organic or inorganic). The additive desirably affects the properties of the stripping composition, particularly, the proton activity thereof. For example, the secondary inorganic acid may increase the coating removal rate by increasing the proton concentration (pH) in the solution. The reducing and oxidizing agents modify the activity or potential of the solution. The complexing agent affects proton concentration by complexing with components in solution, such as metal ions formed by oxidation of components of the aluminide coating.

The use of such additives may be advantageous in combination with a particular first class acid, such as MSA (methanesulfonic acid). As described in more detail below with respect to the examples herein, stripping compositions containing MSA in aqueous solution were particularly effective in removing aluminides containing platinum. The effectiveness of the first class acids may be further improved by use of additives, particularly for removing non-platinum containing aluminide coatings, that is, regions of an aluminide coating free of platinum. Non-platinum containing aluminides are sometimes present along areas of a substrate, such as along a tip portion of a turbine blade that has been repaired using known welding techniques, where a platinum layer is not first deposited. The following additives may be used in combination within individual categories and across categories.

The solvent additive includes alcohols (e.g. ethanol, isopropanol), substituted alkylethers (di-hydroxyethyl ether, di(propylene/ethylene glycol) methyl ether, diethylene glycol monobutyl ether), substituted ketones (e.g. acetone, 1,5-dihydroxypentan-3-one, 1-methyl-2-pyrrolidone), or glycols (e.g. polyethylene glycol, glycerol, dimethylene glycol, ethylene glycol). In one embodiment, the solvent additive is present in an amount of about 1–55 wt %, such as about 10–40 wt %., and more particularly about 20–35wt % of the total stripping composition.

The oxidizing agent additive includes nitrate and nitrous salts; chloride salts; hydride and fluoride salts; sulfate, sulfite and sulfide salts; phosphate and phosphite salts; borate salts; fluoro-aluminate and chloro-aluminate salts; oxyhalide salts; peroxides; chromate salts; and manganate salts. In one embodiment, the oxidizing agent additive is present in an amount of about 1–30 wt %, such as about 2–20 wt %, and more particularly about 2–15 wt % (based on 100% concentration of the oxidizing agent) of the total stripping composition.

The organic complexing agent additive includes two categories, substituted aromatics (e.g. nitro, hydroxy, carboxyl, and sulfate substitutions at various positions on the aromatic ring, and their combinations) and substituted alkyl carboxylic acids (e.g. tartaric acid, citric acid, oxalic acid). The inorganic complexing agent additive includes halides, oxyhalides, sulfates, phosphates, and nitrates. In one embodiment, the inorganic or inorganic complexing agent additive is present in an amount of about 1–10 wt %, such as about 1–5 wt % of the total stripping composition.

The secondary inorganic acid additive includes nitric, hydrochloric, phosphoric, perchloric, triflic, and trifluoroacetic acids, including combinations thereof. In one embodiment, the secondary inorganic acid additive is present in an amount of about 0.1–10 wt % (based on 100% concentration) of the total stripping composition. In combination with the secondary inorganic acid, a reducing agent may also be incorporated. In one embodiment, the reducing agent additives include materials having high redox potentials, including, for example, alkaline earth hydroxides, $Al(OH)_3$, borates, phosphates, silicates, aluminates, $Na_3AlF_6$, $Na_2SiF_6$, and $Na_2SiO_3$, present in an amount of 0.1–10 wt %, such as 0.1–5 wt %. A particular example is hypophosphite, such as sodium hypophosphite.

Generally, the above addititives are added to an aqueous solution containing at least one acid of the first class acids. In one embodiment, the acid is present in the stripping composition within a range of about 10–80 wt %, such as about 30–45 wt % of the total stripping composition, including additives.

The particular stripping composition may be applied to the substrate in a variety of ways. For example, it can be brushed or sprayed onto the surface. Very often, immersion of the substrate in a bath of the stripping composition is the most practical technique. The bath is preferably maintained at a temperature below about 170° F. (77° C.) while the substrate is immersed therein. In a particular embodiment, the bath is maintained at a temperature below about 130° F. (54° C.). The process could be carried out at room temperature, although a higher temperature range would usually be maintained to ensure process consistency if the room temperature is variable. Higher temperatures (within the boundaries set forth above) sometimes result in more rapid removal of the aluminide coating.

In general, though, an advantage of the embodiments of the invention is that bath temperatures are lower than those of the prior art. Use of the lower temperatures according to the present method protects the masking materials which are often present, as discussed previously. The lower temperatures also represent cost savings in terms of energy usage, while also reducing some of the safety hazards associated with higher-temperature baths, e.g., in those situations where volatile components are present in the baths.

The baths containing the stripping compositions are often stirred or otherwise agitated while the process is carried out, to permit maximum contact between the stripping agent and the coating being removed. A variety of known techniques could be used for this purpose, such as the use of impellers, ultrasonic agitation, magnetic agitation, gas bubbling, or circulation-pumping. Immersion time in the bath will vary, based on many of the factors discussed above. On a commercial scale, the immersion time will usually range from about 15 minutes to about 400 minutes. In some embodiments, the immersion time will be a period less than about 150 minutes. In particular embodiments, the immersion time will be a period less than about 75 minutes.

Exposure to the stripping composition causes the aluminide coating on the surface of the substrate to become degraded. As shown in the photomicrograph of FIG. 1, deep cracks are evident in the coating; its integrity has diminished, and its adhesion to the substrate has substantially decreased. In some embodiments, the surface is then briefly rinsed, e.g., by immersion in water or an aqueous solution for less than about 1 minute.

The degraded coating is then removed without damaging the substrate. In one embodiment, this step is carried out by abrading the substrate surface. In contrast to prior art processes, this embodiment includes a "gentle" abrasion step which minimizes damage to the substrate. As an example, a light grit-blasting can be carried out by directing a pressurized air stream containing silicon carbide particles across the surface at a pressure of less than about 80 psi, and preferably, less than about 60 psi, such as less than about 40 psi. Various abrasive particles may be used for the grit-blasting, e.g., metal oxides such as alumina, carbides such as silicon carbide, mixed metal oxides, nitrides, glass beads, crushed glass, sodium carbonate, and crushed corn cob. The average particle size should be less than about 500 microns, and preferably, less than about 100 microns.

The grit-blasting is carried out for a time period sufficient to remove the degraded coating. The duration of grit-blasting in this embodiment will depend on various factors. In the case of an aluminide coating having a deposited thickness of about 50 microns to about 100 microns, grit-blasting will usually be carried out for about 60 seconds to about 120 seconds, when utilizing an air pressure of about 20 psi to about 30 psi, and when using grit particles of less than about 100 microns. These parameters represent a suitable guideline for each of the types of stripping compositions set forth above.

Other known techniques for lightly abrading the surface may be used in lieu of grit-blasting. For example, the surface could be manually scrubbed with a fiber pad, e.g. a pad with polymeric, metallic, or ceramic fibers. Alternatively, the surface could be polished with a flexible wheel or belt in which alumina or silicon carbide particles have been embedded. Liquid abrasive materials may alternatively be used on the wheels or belts. For example, they could be sprayed onto a wheel, in a vapor honing process. (The abrasive material should be one which does not adversely affect the substrate.). These alternative techniques would be controlled in a manner that maintained a contact force against the substrate surface that was no greater than the force used in the gentle grit-blasting technique discussed above.

Other techniques could be employed in place of abrasion, to remove the degraded material. One example is laser ablation of the surface. Alternatively, the degraded material could be scraped off the surface. As still another alternative, sound waves (e.g., ultrasonic) could be directed against the surface. The sound waves, which may originate with an ultrasonic horn, cause vibrations which can shake loose the degraded material.

In some instances, the degraded coating could be removed by aggressive agitation, e.g., agitation with a force greater than that produced with the ultrasonic technique itself. For example, the substrate could be immersed in a bath which is rapidly stirred with a mechanical stirrer (i.e., for "general agitation"), and which is also ultrasonically-stirred (i.e., for "local agitation"). Agitation would be carried out until the degraded material is shaken loose.

For each of these alterative techniques, those skilled in the art would be familiar with operating adjustments that are made to control the relevant force applied to the substrate (as in the case of the abrasion technique), to minimize damage to the substrate surface.

In some optional embodiments, it is desirable to include an extended rinsing step between step (a) and step (b). This step involves contacting the degraded aluminide coating with an aqueous solution comprising water and a wetting agent like those described previously. Preferred wetting agents for this step are polyalkylene glycols like polyethylene glycol. They are usually present at a level of about 0.1% to about 5% by weight, based on the total weight of the rinsing solution. Rinsing can be carried out by a variety of techniques, but is usually undertaken by immersing the substrate in an agitated bath of the rinsing solution, for about 1 minute to about 30 minutes.

Figure 2:
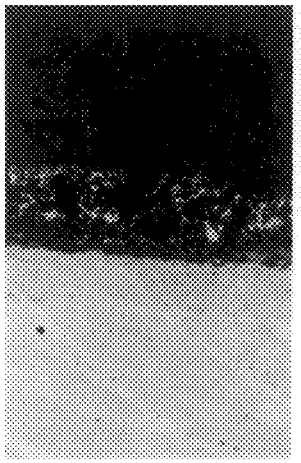
FIG. 2 is a photomicrograph of the cross-section of FIG. 1, after another stage of treatment.

With reference to FIG. 2, it can be seen that the extended rinsing step removes the chunks of aluminide particles shown in the FIG. 1. In this instance, the remaining thin layer of more coherent aluminide material is subsequently removed in an abrasion step, such as by grit blasting. The use of the extended rinsing step usually decreases the time required for carrying out the abrasion step. For the illustrative set of grit-blasting parameters described above, the time may be reduced to a period of about 5 seconds to about 45 seconds, for example. The use of the alternative techniques for step (b) can result in the elimination of any abrasion step, as discussed previously.

After grit-blasting, compressed air is usually blown across the substrate to remove any residual aluminide particles or abrasive particles. The substrate can then be re-coated with any desirable material. For example, platinum-aluminide protective coatings for engine parts can again be applied to the high-quality surface of the superalloy, which has been substantially unaffected in the earlier stages of coating repair.

In some embodiments of this invention, the substrate surface is contacted with two stripping compositions, in sequence. The first composition is one which very quickly begins to remove the aluminide materials. A specific example is the mixture of the inorganic acid and the solvent which reduces the activity of the inorganic acid relative to the substrate, as described previously. Illustrative compositions of this type are hydrochloric acid with an alcohol such as ethanol; and sulfuric acid with water.

The second stripping composition is one which is capable of removing the aluminide material more slowly, and with no pitting or attack on the substrate, except for the possible occurrence of uniform corrosion, as discussed previously. One example is the stripping composition based on an alkane sulfonic acid, such as methanesulfonic acid, as described previously.

Typically, each stripping composition is used in the form of a bath in which the substrate can be immersed. Contact times and bath temperatures will vary, based on many of the factors described previously, e.g., type and amount of aluminide material requiring removal. Usually, the first bath will be maintained at a temperature in the range of about 0° C. to about 40° C., with an immersion time between about 5 minutes and about 20 minutes. The second bath will typically be maintained at a temperature in the range of about 40° C. to about 60° C., with an immersion time between about 30 minutes and about 120 minutes.

As in previous embodiments, the surface can then be subjected to a gentle abrasion step (or similar technique) to remove the degraded coating, e.g., by light grit-blasting. Moreover, in some embodiments, the abrasion step can be preceded by an extended rinsing step, as also described above. In general, this embodiment is useful for situations that require relatively short process times, and a high removal rate for the aluminide, without any adverse effect on the substrate. These are also situations in which a two-stage procedure for treatment with the stripping composition would be acceptable.

The substrate on which the aluminide coating is disposed can be any metallic material or alloy which is typically protected by a thermal barrier coating. Often, the substrate is a heat-resistant alloy, such as a superalloy, including nickel-base, cobalt-base, and iron-base high temperature superalloys. Typically the superalloy is a nickel-base material or cobalt-base material, where nickel or cobalt is the single greatest element by weight in the alloy. Illustrative nickel-base alloys are designated by the trade names Inconel®, Nimonic®, Rene® (e.g., Rene® 80-, Rene® 125, Rene® 142, and Rene® N5 alloys), and Udimet®. The type of substrate can vary widely, but it is often in the form of a jet engine part, such as an airfoil component. As another example, the substrate may be the piston head of a diesel engine, or any other surface requiring a heat-resistant barrier coating with a substantially smooth surface.

EXAMPLES

The examples that follow illustrate some embodiments of this invention, and should not be construed to be any sort of limitation on its scope.

Each of the following test samples 1–5 was a button made from a nickel-based superalloy, Rene® N-5, having a thickness of 0.125 inch (0.32) cm, and a diameter of 1 inch (2.4 cm). Prior to deposition of the aluminide coating, the buttons were grit-blasted with alumina and cleaned. The surface of each button was electroplated with platinum to a depth of about 7.5 microns, followed by diffusion-aluminiding of the surface to a depth of about 50 microns.

Example 1

Sample 1 was treated according to a prior art process, involving two steps which included stripping compositions. In the first step, one of the buttons was immersed in a bath formed from a 50:50 (by weight) mixture of nitric acid and phosphoric acid. The bath was maintained at a temperature of about 170° F. to 190° F. (77–88° C.). After 2–4 hours, the sample was removed from the bath and rinsed in water for 20 minutes. The button was then immersed in a bath of 20–40% (by weight) hydrochloric acid in water, maintained at about 150–165 ° F. (66–74° C.). The immersion time for the second bath was about 30–60 minutes. After removal from the second bath, the sample was rinsed again in water for about 20 minutes, and then examined.

Example 2

Sample 2 was treated according to one embodiment of the present invention. One of the buttons was immersed in a bath formed from a 50:50 (by weight) mixture of methanesulfonic acid and water. The bath was maintained at a temperature of 120° F. (49° C.). After 45 minutes, the button was removed from the bath and rinsed in water for 20 minutes. The button was then gently grit-blasted. The grit-blasting was carried out by directing a pressurized air stream containing silicon carbide particles across the button surface at a pressure of about 20 psi. The silicon carbide particles had an average particle size of less than 50 microns. The button was then examined.

Example 3

Sample 3 was treated according to another embodiment of the present invention. One of the buttons was immersed in a bath formed from a 50:50 (by weight) mixture of hydrochloric acid (37.7 wt. % in water) and ethanol. The bath was maintained at a temperature of 120° F. (49° C.). After 45 minutes, the button was removed from the bath and rinsed in water for 20 minutes. The button was then gently grit-blasted. The grit-blasting was carried out according to the specifications for sample 2. The button was then examined.

Example 4

Sample 4 was treated according to another embodiment of the present invention. One of the buttons was immersed in a bath of 25% (by weight) sulfuric acid in water. The bath was maintained at a temperature of 120° F. (49° C.). After 30 minutes, the button was removed from the bath and rinsed in water for 20 minutes. The button was then gently grit-blasted according to the specifications for sample 2, and examined.

Example 5

Sample 5 was treated according to still another embodiment of this invention, utilizing two different stripping compositions. A button, as described previously, was first immersed in a bath formed from a mixture of hydrochloric acid and ethanol, as in Example 3. The bath was maintained at a temperature of 77° F. (25° C.). After 10 minutes, the button was removed from the bath and rinsed in water for 20 minutes. The button was then immersed in a bath of methanesulfonic acid and water, as described in Example 2. The bath was maintained at a temperature of 73° F. (23° C.). After 45 minutes, the button was removed from the bath and rinsed in water for 20 minutes. The button was then gently grit-blasted, as described in the previous examples, and examined.

The process parameters and results are set forth in Table 1. "Selectivity" is defined as the ratio of the amount of coating material lost to the amount of substrate material lost during the stripping step(s). A higher ratio is a desirable indication that the aluminide coating material is being removed while minimizing the removal of any of the substrate material.

TABLE 1

| Sample # | Stripping Composition HNO3—H3PO4/HCl— | Selectivity[a] | Evidence of Pitting or IGA* | Time** (min) | Temp.*** (° C.) |
|---|---|---|---|---|---|
| 1[c] | Waterb | 14 | Observed | 150–300[d] | 77–88 |
| 2 | Methane-Sulfonic Acid | 5 | None | 45 | 49 |
| 3 | HCl-Ethanol | 50 | Very | 45 | 49 |

TABLE 1-continued

| Sample # | Stripping Composition HNO3—H3PO4/HCl— | Selectivity[a] | Evidence of Pitting or IGA* | Time** (min) | Temp.*** (° C.) |
|---|---|---|---|---|---|
| 4 | Sulfuric Acid | 15 | Slight Slight | 30 | 49 |
| 5 | HCl—Ethanol/MSA[b] | 42 | None | 45 | 49 |

[a]Grams coating material removed/grams substrate material removed
[b]2-step stripping process; MSA = methanesulfonic acid
[c]Comparative example
[d]Total immersion time
*IGA = intergranular attack
**Immersion time in bath of stripping composition
***Bath temperature The above results demonstrate the advantages of various embodiments of the present invention. The process of Example 1 (i.e., sample 1), which represents the prior art, resulted in a significant amount of pitting and intergranular attack of the substrate surface. Moreover, the time required for the process was lengthy. In contrast, the processes for Examples 2–4 (samples 2–4) required much less time, and utilized much lower temperatures. The process of Example 5 (sample 5), utilizing the two-step stripping procedure according to some embodiments of this invention, also provided desirable coating removal and selectivity, with no adverse effects on the substrate surface.

FIG. 1 is a photomicrograph of a cross-section of a platinum-aluminide coating applied on a nickel-based superalloy substrate, after treatment with a methanesulfonic acid stripping composition according to this invention. Degradation of the layer of platinum-aluminide material is clearly apparent.

FIG. 2 is a photomicrograph of the cross-section of FIG. 1, after the degraded coating has been immersed in a rinsing composition of water and polyethylene glycol (1% PEG by weight) for about 20 minutes. This step rapidly removed the larger chunks of coating material, leaving only a thin layer of aluminide material on the substrate.

Figure 3:
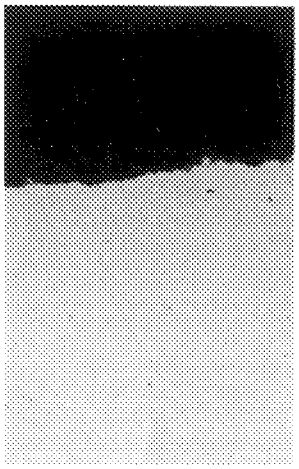
FIG. 3 is a photomicrograph of the cross-section of FIG. 2, after another stage of treatment.

FIG. 3 is a photomicrograph of the cross-section of FIG. 2, after the rinsed surface has been gently grit-blasted, as described in the examples. Grit-blasting of less than about 120 seconds resulted in complete removal of the remaining aluminide coating, without damage to the substrate.

The following Examples 6–15 were prepared to evaluate the first class of stripping compounds including aliphatic and aromatic acids with at least one organic or inorganic additive. The example substrates were constructed of Rene®80, Rene®142 and Rene®5 superalloy base metals having a non-platinum containing aluminide (non-platinum aluminide) coating and a platinum-aluminide coating. The samples were typically treated for four hours with the stripping solution at 150° F. (or lower) followed by an ultrasonic bath and a grit dusting. The extent of coating removal was verified by a heat tint process and by microscopy. The samples were checked for IGA and pitting of the base metal using microscopy.

Example 6 (acid-acid mixture)

A mixture of methanesulfonic acid (MSA), hydrochloric acid 380 baume (HCl) and water (38:15:47 wt %) was used to strip a platinum aluminide coating and non-platinum aluminide coating from a high pressure turbine (HPT) blade. The part was immersed in the solution for 4 hrs at 50° C.

with ultrasonic agitation, which was followed by a water/polyethylene glycol rinse for 15 min with ultrasonic agitation. The part was then grit blasted at 60 psi to remove the degraded coating. The coating was completely removed, as determined by the heat tint process and microscopy. Slight IGA was noticed in the bare metal micrographs.

Example 7 (acid/acid/reducer)

Various field run HPT blades with a platinum aluminide coating having a previous aluminide tip repair (forming a non-platinum aluminide coating region), were treated with a mixture of MSA, HCl, sodium hypophosphite, and water (40:10:2:48 wt %). The part was immersed in the solution and ultrasonically agitated for 4 hrs at 50° C., followed by a water/polyethylene glycol rinse for 15 min with ultrasonic agitation. The part was then grit blasted at 60 psi to remove the degraded coating. Heat tint and microscopy both showed the part to be completely stripped of both the platinum aluminide and the non-platinum aluminide coatings, with no attack on the base metals.

Example 8 (acid/acid/complexing agent)

Various field run HPT blades with both platinum aluminide and non-platinum aluminide coatings on nickel based superalloy were stripped in a solution of MSA, water, HCl, and dinitrobenzenesulfonic acid (NBSA) (41:51:5:3 wt %). The stripping solution was maintained at 50° C. with ultrasonic agitation, which was followed by a water/polyethylene glycol rinse for 15 min with ultrasonic agitation. The part was then grit blasted at 60 psi to remove the degraded coating. Heat tint and microscopy both showed the part to be completely stripped of both the platinum aluminide and the non-platinum aluminide coatings, with no attack on the base metals.

Example 9 (acid/acid/solvent)

Various coupons, having either platinum aluminide or non-platinum aluminide coatings, were stripped using MSA, HCl, and diethylene glycol (DEG) /water (38:15:47 wt %). The DEG/water mixture was varied from all DEG to all water. ⅔ DEG and ⅓ water by volume was found to be the most effective. The stripping solution was maintained at 50° C. with ultrasonic agitation, which was followed by a water/polyethylene glycol rinse for 15 min with ultrasonic agitation. The coupons were then grit blasted at 60 psi to remove the degraded coating. Heat tint and microscopy both showed the coupons to be a completely stripped of both the platinum aluminide and the non-platinum aluminide coatings, with no attack on the base metals.

Example 10 (acid/acid/oxidizer)

Various field run HPT parts having both platinum aluminide and non-platinum aluminide coatings were stripped using a solution of MSA, water, nitric acid 70° baume, and hydrogen peroxide (50 wt % concentration in water) (25:30:25:20 wt %). The parts were immersed in the stripping solution, maintained at 50° C. with ultrasonic agitation, followed by a water/polyethylene glycol rinse for 15 min with ultrasonic agitation. The parts were then grit blasted at 60 psi to remove the degraded coating. Heat tint and microscopy both showed the part to be completely stripped of both the platinum aluminide and the aluminide coatings, with no attack on the base metals.

Example 11 (acid/oxidizer)

Various field run HPT parts having both platinum aluminide and non-platinum aluminide coatings were stripped using a solution of MSA, water, hydrogen peroxide (50 wt % concentrator water) (36:44:20 vol %). The parts were immersed in the stripping solution, maintained at 50° C. with ultrasonic agitation, followed by a water/polyethylene glycol rinse for 15 min with ultrasonic agitation. The parts were then grit blasted at 60 psi to remove the degraded coating. Heat tint and microscopy both showed the part to be completely stripped of the platinum aluminide and non-platinum aluminide coatings, with no attack on the base metals.

Example 12 (acid/additional acids)

Various field run HPT parts were stripped using a solution of hydrochloric, nitric, lactic and acetic acid (30:10:30:30 vol %). The parts were immersed in the stripping solution, which was run at 50° C. with mechanical agitation, followed by a water rinse for 15 min with ultrasonic agitation. The parts were then grit blasted at 60 psi to remove the degraded coating. Heat tint and microscopy both showed the part to be completely stripped of both the platinum aluminide and the non-platinum aluminide coatings, with no attack on the base metals.

Example 13 (acid/acid/oxidizer)

Various field run HPT parts were stripped using a solution of MSA, water , HCl, potassium permanganate (36:44:10:10 wt %). The parts were immersed in the stripping solution, which was run at 50° C. with ultrasonic agitation, followed by a water/polyethylene glycol rinse for 15 min with ultrasonic agitation. The parts were then grit blasted at 60 psi to remove the degraded coating. Heat tint and microscopy both showed the part to be completely stripped of both the platinum aluminide and the non-platinum aluminide coatings. Microscopy indicated IGA on a dovetail portion of the HPT parts.

Example 14 (acid/oxidizer)

Various field run HPT parts were stripped using a solution of MSA, water, iron (Ill) chloride (40:50:10 wt %). The parts were immersed in the stripping solution, which was run at 50° C. with ultrasonic agitation, followed by a water/polyethylene glycol rinse for 15 min with ultrasonic agitation. The parts were then grit blasted at 60 psi to remove the degraded coating. Heat tint and microscopy both showed the part to be completely stripped of both the platinum aluminide and the non-platinum aluminide coatings. Microscopy indicated some IGA on the dovetail.

Example 15 (acid/acid/oxidizer)

Various field run HPT parts were stripped using a solution of MSA, water, HCl, sodium aluminum fluoride (37:45:15:3 wt %). The parts were immersed in the stripping solution, which was run at 50° C. with ultrasonic agitation, followed by a water/polyethylene glycol rinse for 15 min with ultrasonic agitation. The parts were then grit blasted at 60 psi to remove the degraded coating. Heat tint and microscopy both showed the part to be completely stripped of both the platinum aluminide and the non-platinum aluminide coatings, with no attack on the base metals.

The acid systems according to embodiments of the present invention exhibit desirable selectivity in removing both the diffusion platinum aluminide and non-platinum aluminide coatings, while leaving the base metal relatively unaffected. The solutions of Example 6- MSA/HCl, Example 13 - MSA/HCl/$KMnO_4$, and Example 14- MSA/

FeCl3, cause only slight IGA to the base metal, and are viable solutions for single crystal parts, or in cases when a slight amount of IGA is allowable. While each of the compositions of EXAMPLES 6–15 was effective in stripping non-platinum aluminide and platinum-aluminide coatings, those of EXAMPLES 7 and 15 above were particularly effective.

According to embodiments of the present invention, platinum aluminide and non-platinum aluminide coatings were removed at low temperatures and under short durations, thereby avoiding attack on the masking materials. In addition, by operating at a reduced temperature and by having low volatility, embodiments of the present invention exhibited low loss of solution due to evaporation. Accordingly, less frequent addition of water and acids is required during use.

While the foregoing description relates generally to removing a layer such as an aluminide coating, one particular composition, MSA, may be used in connection with removal of other materials. Particularly, it has been found that MSA is effective at removing deposited oxides from turbine engine components, which oxides are deposited during actual use of gas turbine engines. Such oxides are generally removed during a cleaning step prior to removal of the aluminide layer. The oxides are referred to in the art as CMAS (calcium, magnesium, aluminum, and silicon) oxides. In one technique, a cleaning composition containing a 50% concentration of MSA in water is exposed to the component for about one hour at about 60° C.

Various embodiments of this invention have been described herein. However, this disclosure should not be deemed to be a limitation on the scope of the claimed invention. Accordingly, various modifications, adaptations, and alternatives may occur to one skilled in the art without departing from the scope of the present claims.

What is claimed is:

1. A method for removing an aluminide coating from a surface of a substrate, comprising the steps of:

contacting the surface of the substrate with at least one stripping composition, said stripping composition comprising an aliphatic or aromatic sulfonic acid, and at least one inorganic additive, said at least one inorganic additive selected from a group consisting of a. secondary acids selected from a group consisting of nitric acid, hydrochloric acid, phosphoric acid, perchloric acid, triflic acid, trifluoroacetic acid, sulfuric, boric, hypophosphorous, and combinations thereof, b. complexing agents selected from a group consisting of halides, oxyhalides, sulfates, phosphates, and nitrates, c. oxidizing agents selected from a group consisting of nitrate and nitrous salts; chloride salts; hydride and fluoride salts; sulfate, sulfite, and sulfide salts; phosphate and phosphite salts; borate salts; fluoro- and chloro-aluminate salts; oxyhalide salts; peroxides; and manganate salts, and d. reducing agents; and removing the coating.

2. The method of claim 1, wherein the sulfonic acid is selected from the group consisting of methanesulfonic acid, ethanesulfonic acid, benzene sulfonic acid, toluene sulfonic acid, and naphthalene sulfonic acid.

3. The method of claim 1, wherein the sulfonic acid is methanesulfonic acid.

4. The method of claim 1, wherein the secondary acid is present in the stripping composition in an amount of about 0.1–10.0 wt %.

5. The method of claim 4, wherein the inorganic additive further includes said reducing agent.

6. The method of claim 5, wherein the reducing agent comprises a material from a group consisting of alkaline earth hydroxides, $Al(OH)_3$, borates, phosphates, silicates, aluminates, $Na_3AlF_6$, $Na_2SiF_6$, and $Na_2SiO_3$ present in an amount of about 0.1–10 wt %.

7. The method of claim 1, wherein said secondary acid is hydrochloric acid.

8. The method of claim 7, wherein the hydrochloric acid is present in an amount of 0.1–10 wt %.

9. The method of claim 8, wherein the inorganic additive further includes the reducing agent, wherein the reducing agent is sodium hypophosphite present in an amount of about 0.1 to 10 wt %.

10. The method of claim 1, wherein the oxidizing agent is present in the stripping composition in an amount of about 1–30 wt %.

11. The method of claim 1, wherein the step of contacting is carried out by immersing the substrate in a bath of the stripping composition.

12. The method of claim 11, wherein the bath is maintained at a temperature below about 170° F. while the substrate is immersed therein.

13. The method of claim 12, wherein the bath is maintained at a temperature below about 130° F. while the substrate is immersed therein.

14. The method of claim 1, wherein removal of the coating is carded out by abrading.

15. The method of claim 14, wherein abrading comprises grit blasting.

16. The method of claim 15, wherein the grit blasting is carried out with particles having a particle size less than about 100 microns.

17. The method of claim 1, wherein the coating is removed by agitating the substrate in an aqueous bath.

18. The method of claim 1, wherein the aluminide-coating comprises platinum aluminide region and a non-platinum aluminide region, said non-platinum aluminide region being free of platinum.

19. The method of claim 18, wherein the non-platinum aluminide region comprises a nickel aluminide.

20. The method of claim 1, wherein the substrate comprises a nickel-based superalloy or a cobalt-based superalloy.

21. A method for removing an aluminide coating from a surface of a substrate, comprising the following steps:

contacting the surface of the substrate with it least one stripping composition, said stripping composition comprising an aliphatic or aromatic sulfonic acid, and at least one organic additive, said at least one organic additive selected from the group consisting of a. a complexing agent selected from a group consisting of substituted aromatics and substituted carboxylic acids, and b. a solvent selected from a group consisting of, substituted alkylethers, substituted ketones, and glycols; and removing the coating.

22. The method of claim 21, wherein the sulfonic acid is selected from the group consisting of methanesulfonic acid, ethanesulfonic acid, benzene sulfonic acid, toluene sulfonic acid, and naphthalene sulfonic acid.

23. The method of claim 21, wherein the sulfonic acid is methanesulfonic acid.

24. The method of claim 21, wherein the complexing agent is present in the stripping composition in an amount of about 1–100 wt %.

25. The method of claim 21, wherein the complexing agent is a substituted aromatic containing a nitro, hydroxy, car boxyl, or sulfate component.

26. The method of claim 25, wherein the complexing agent is dinitrobenzenesulfonic acid.

27. The method of claim 21, wherein the complexing agent is a substituted carboxylic acid, said substituted carboxylic acid being selected from a group consisting of tartaric acid, citric acid, and oxalic acid.

28. The method of claim 21, wherein the solvent is present in the stripping composition in an amount of about 1–80 wt/%.

29. The method of claim 21, wherein the step of contacting is carried out by immersing the substrate in a bath of the stripping composition.

30. The method of claim 29, wherein the bath is maintained at a temperature below about 170° F. while the substrate is immersed therein.

31. The method of claim 21, wherein removal of the coating is carried out by abrading.

32. The method of claim 21, wherein the coating is removed by agitating the substrate in an aqueous bath.

33. The method of claim 21, wherein the aluminide-coating comprises platinum aluminide region and a non-platinum aluminide region, said non-platinum aluminide region being free of platinum.

34. The method of claim 33, wherein the non-platinum aluminide region comprises a nickel aluminide.

35. The method of claim 21, wherein the substrate comprises a nickel-based superalloy or a cobalt-based superalloy.

36. A method for removing an aluminide coating from a surface of a substrate, comprising the steps of:

contacting the surface of the substrate with at least one stripping composition to degrade the coating, said stripping composition comprising methanesulfonic acid, hydrochloric acid, and at least one agent from the group consisting of a reducing agent and an oxidizing agent; and removing the coating.

37. The method of claim 36, wherein the composition includes said reducing agent, and said reducing agent comprises sodium hypophosphite.

38. The method of claim 36, wherein the composition includes said oxidizing agent, and said oxidizing agent comprises sodium aluminum fluoride.

* * * * *